US009168586B2

(12) United States Patent
Nitzl et al.

(10) Patent No.: US 9,168,586 B2
(45) Date of Patent: Oct. 27, 2015

(54) STOPPER ROD

(75) Inventors: Gerald Nitzl, Bocholt (DE); Norman Edward Rogers, Derbyshire (GB)

(73) Assignee: REFRACTORY INTELLECTUAL PROPERTY GMBH & CO KG, Vienna (AT)

( * ) Notice: Subject to any disclaimer, the term of this patent is extended or adjusted under 35 U.S.C. 154(b) by 912 days.

(21) Appl. No.: 12/734,426

(22) PCT Filed: Nov. 12, 2008

(86) PCT No.: PCT/GB2008/003795

§ 371 (c)(1),
(2), (4) Date: Nov. 15, 2011

(87) PCT Pub. No.: WO2009/066052

PCT Pub. Date: May 28, 2009

(65) Prior Publication Data

US 2012/0055957 A1 Mar. 8, 2012

(30) Foreign Application Priority Data

Nov. 24, 2007 (EP) ..... 07254572

(51) Int. Cl.
*B22D 41/18* (2006.01)
*B22D 41/08* (2006.01)

(52) U.S. Cl.
CPC ..... *B22D 41/186* (2013.01)

(58) Field of Classification Search
CPC ..... B22D 41/186; B22D 41/18; B22D 41/20; B22D 41/08; B22D 41/16; B22D 41/58; F27D 3/1509; F27D 3/1536
USPC ..... 222/602, 603, 590; 266/220, 217
See application file for complete search history.

(56) References Cited

U.S. PATENT DOCUMENTS

| | | | | | |
|---|---|---|---|---|---|
| 4,691,901 | A * | 9/1987 | Dobner | 266/236 |
| 4,706,944 | A * | 11/1987 | Lee | 266/272 |
| 4,791,978 | A * | 12/1988 | Fishler | 164/437 |
| 4,946,083 | A * | 8/1990 | Fishler et al. | 222/602 |
| 5,024,422 | A * | 6/1991 | Fishler et al. | 266/272 |
| 7,198,181 | B2 * | 4/2007 | Richard et al. | 222/602 |
| 2004/0164465 | A1 | 8/2004 | Richard et al. | |
| 2008/0106011 | A1 * | 5/2008 | Lee et al. | 266/272 |

FOREIGN PATENT DOCUMENTS

| | | | |
|---|---|---|---|
| FR | 2 787 045 | A1 | 6/2000 |
| JP | 02-006040 | A | 1/1990 |

(Continued)

OTHER PUBLICATIONS

Translation of Notice of Reasons for Rejection, including List of Cited References; Japanese Patent Application No. 2010-534534, pp. 1-4, Mailing No. 741922, Mailing Date Oct. 15, 2010.

*Primary Examiner* — Scott Kastler
*Assistant Examiner* — Michael Aboagye
(74) *Attorney, Agent, or Firm* — Nixon & Vanderhye P.C.

(57) ABSTRACT

Stopper rod having an elongate body with an inlet at an upper first end and an outlet at a lower second end. The second end of the body defines a nose for insertion into a tundish outlet. A continuous axial bore extends through the body from the inlet in the first end to the outlet in the second end. A restrictor having an inlet, an outlet and a passageway therebetween is positioned in the axial bore such that the inlet of the restrictor is closer to the first end than the second end. A gas supply conduit is arranged to supply gas into the axial bore above the inlet of the restrictor.

11 Claims, 4 Drawing Sheets

(56) References Cited

FOREIGN PATENT DOCUMENTS

| | | | |
|---|---|---|---|
| JP | 2001-191152 | A | 7/2001 |
| WO | WO 99/28066 | | 6/1999 |
| WO | WO 01/08837 | A1 | 2/2001 |
| WO | WO01/08837 | A1 | 2/2001 |
| WO | WO 2009/066052 | A1 | 5/2009 |

* cited by examiner

FIG 3
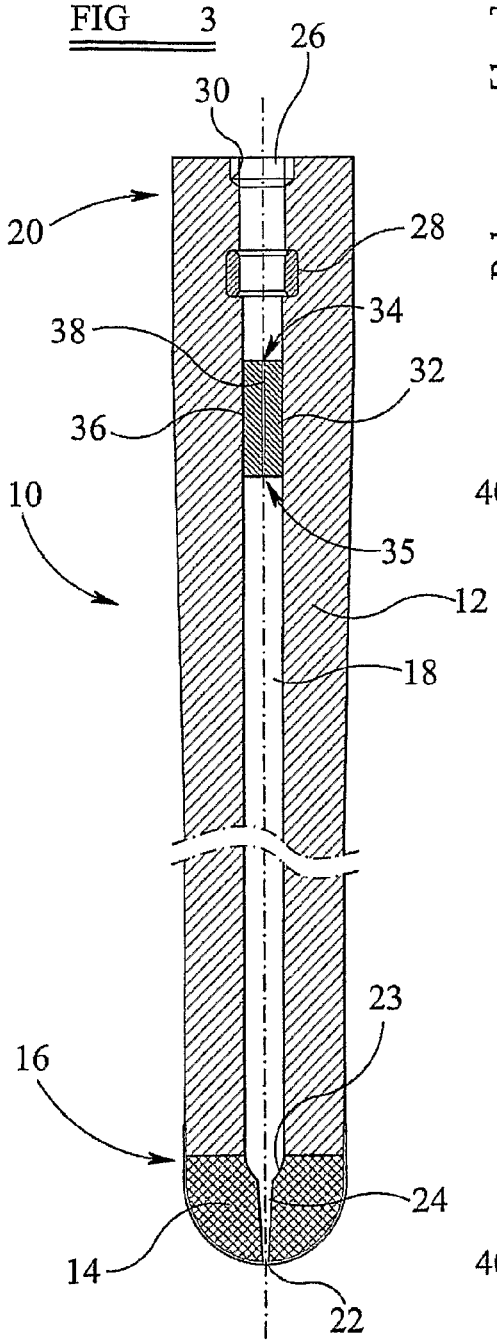
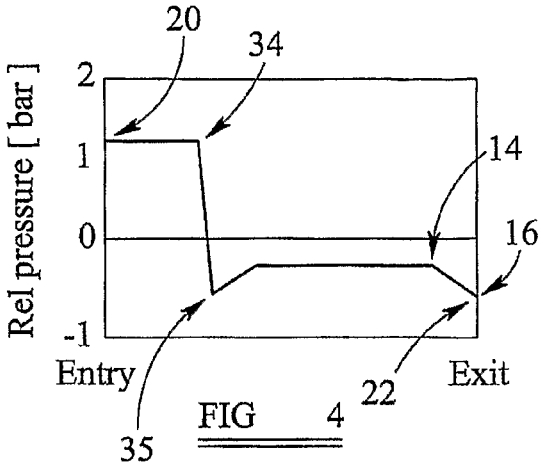
FIG 4
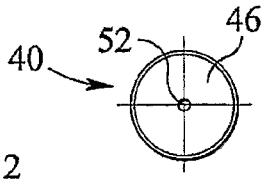
FIG 5A
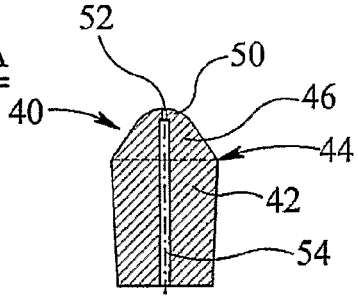
FIG 5B
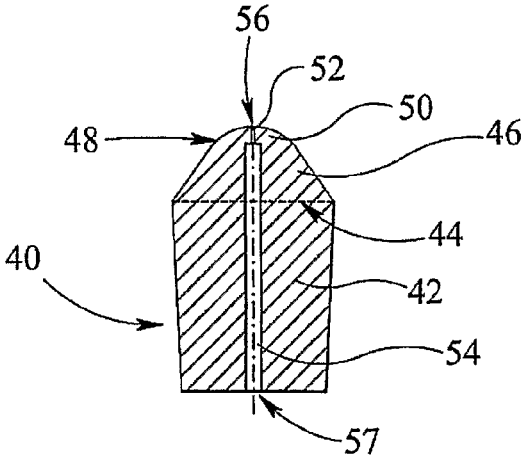
FIG 5C

STOPPER ROD

This application is the U.S. national phase of International Application No. PCT/GB2008/003795 filed 12 Nov. 2008 which designated the U.S. and claims priority to European Application No. 07254572.6 filed 24 Nov. 2007, the entire contents of each of which are hereby incorporated by reference.

FIELD OF THE INVENTION

This invention relates to a stopper rod. Particularly, but not exclusively, the invention relates to a stopper rod for regulating the flow of molten metal from a tundish to a mould during a continuous casting process.

BACKGROUND TO THE INVENTION

In a continuous casting steel-making process, molten steel is poured from a ladle into a large holding vessel known as a tundish. The tundish has one or more outlets through which the molten steel flows into one or more respective moulds. The molten steel cools and begins to solidify in the moulds to form continuously cast solid lengths of metal. A submerged entry nozzle is located between the each tundish outlet and each mould, and guides molten steel flowing through it from the tundish to the mould. A stopper rod controls the flow rate of the molten steel through the submerged entry nozzle.

The stopper rod generally comprises an elongate body having a rounded nose at one end thereof. In use, the rod is orientated vertically along its axis and is disposed with its nose adjacent the throat of the submerged entry nozzle such that raising and lowering of the stopper rod opens and closes the inlet of the submerged entry nozzle and thereby controls the flow of metal therethrough. The nose of the stopper rod is sized to completely close the inlet of the submerged entry nozzle when lowered to a seated position within the throat of the submerged entry nozzle.

A particular problem associated with the casting of molten metal is that inclusions (e.g. alumina) are often present in the molten metal as it is flowed from the tundish to the mould. Such inclusions tend to deposit on the stopper rod nose or within the submerged entry nozzle depending upon the flow conditions within the casting channel. Accordingly, over time the build up of inclusions can affect the geometry of the components to such an extent that the flow control characteristics of the system are altered and the continuous casting sequence may have to be interrupted.

The injection of an inert gas, such as argon, down the centre of the stopper rod and out of a discharge port in the nose of the stopper alleviates alumina build up and clogging. However, the venturi effect of molten metal flowing past the stopper in the throat of the nozzle creates a negative pressure which can be transmitted back into the stopper rod through the discharge port, potentially sucking air into the metal through the stopper if any joints are not airtight. To date, this problem has been addressed by providing a restriction at the interface between the body and the nose of the stopper rod. The restriction may be a simple narrowing of the bore or may be constituted by a plug with a narrow bore therethrough (or a porous plug) fixed in the stopper bore. The restriction creates a backpressure and results in a positive internal pressure in the stopper rod upstream of the restriction. This positive internal pressure inhibits air ingress into the argon supply channel thereby reducing the quantity of contaminants in the metal being cast.

It will be understood that all references to pressure are relative to atmospheric pressure so that negative pressures relate to pressures below atmospheric pressure and positive pressures relate to pressures above atmospheric pressure.

A disadvantage of using a typical restriction, such as that described above, is that over time an increase in internal pressure can arise which can result in the stopper rod cracking or even being blown apart.

It is therefore an aim of the present invention to provide a stopper rod that addresses the afore-mentioned problems.

SUMMARY OF THE INVENTION

According to a first aspect of the present invention there is provided a stopper rod comprising an elongate body having an inlet at an upper first end and an outlet at a lower second end, the second end of the body defining a nose for insertion into a tundish outlet; a continuous axial bore extending through the body from the inlet in the first end to the outlet in the second end; a restrictor having an inlet, an outlet and a passageway therebetween, said restrictor being positioned in the axial bore such that the inlet of the restrictor is closer to the first end than the second end; and a gas supply conduit arranged to supply gas into the axial bore above the inlet of the restrictor.

In one embodiment of the stopper rod, the restrictor is located such that, when the stopper rod is employed to control the flow of molten metal from a tundish, the outlet of the restrictor is below the level of molten metal in the tundish.

According to a second aspect of the present invention there is provided an apparatus for controlling the flow of molten metal from a tundish comprising a tundish configured for receiving molten metal to an operating (steady state) depth and having at least one tundish outlet for discharging molten metal therethrough; a stopper rod according to the first aspect of the invention, orientated vertically with its second end disposed above the at least one tundish outlet and movable vertically into and out of the at least one tundish outlet whereby to control the flow of molten metal, through the at least one tundish outlet; the restrictor in the stopper rod being located vertically within the axial bore such that, in use, the outlet of the restrictor is below the surface of molten metal in the tundish.

The outlet of the restrictor may be located at a distance of less than 70% of the length of the stopper rod when measured from the second end.

It will be understood that, during steady state casting conditions, the level of molten metal in a tundish remains at a substantially constant operating depth—the flow of incoming metal from a ladle being balanced by the flow of outgoing metal to a mould or moulds. It will also be understood that, in use, a slag layer (or layers) may be formed on the surface of the molten metal. Usually there will be a liquid slag layer directly on the surface of the molten metal, but there may be an additional powder layer on top of the liquid slag. For the purposes of the present invention, unless otherwise specified, reference to the surface of the molten metal in the tundish is in fact to the surface of any liquid slag layer. Although individual tundish/stopper assemblies differ, typically, in use, the surface of the molten metal (and the slag layer) is approximately 70-80% of the way up the tundish, with the lower 60-70% of the length of the stopper rod typically immersed in the molten metal in the tundish.

The Applicants have postulated that out-gassing from the immersed (hot) portion of the stopper rod may introduce a number of additional chemical species into the axial bore. The Applicants have also determined that a typical restrictor positioned adjacent the nose of a stopper rod could experience an adiabatic cooling effect of approximately 260° C. (the temperature drop being a function of the gas temperature in the region of the restrictor, the temperature in the nose being approximately 1560° C.): the adiabatic expansion of gas within the restrictor cools the gas significantly, which in turn cools the restrictor itself. Accordingly, the Applicants have postulated that blockages, which appear to occur in typical restrictors, may be caused by gaseous materials (i.e. the reaction products of the out-gassed species) condensing and forming deposits within the restrictor, thereby restricting the flow of gas therethrough and resulting in an increase in backpressure, which can cause the stopper rod to crack or be blown apart. It should be noted, however, that on examination of failed stopper rods there are sometimes no traces of blockages in the restrictors and the Applicants believe that this is because the temperature in the bore rises once the gas stops flowing therethrough and so any deposits are evaporated before they can be detected.

In light of the above, the Applicants have found that providing the inlet to the restrictor towards the cooler (upper) end of the stopper rod reduces the likelihood of chemical depositions which arise from the out-gassed species cooling and condensing as they pass through the restrictor since these species are not present when the gas passes through the restrictor.

The axial length of the restrictor (i.e. the distance between the inlet and the outlet) may be less than 10% and typically between about 2 and 5% of the length of the stopper rod (i.e. the distance between the first end and the second end).

The outlet of the restrictor is preferably spaced from the second end of the stopper rod. It will be understood that, in use, the pressure drops across the restrictor from the inlet to the outlet. Once the gas emerges from the outlet of the restrictor it will expand creating a low-pressure region. This low-pressure will remain substantially constant to the second end of the stopper rod. Thus, in the case where the restrictor is relatively short, the majority of the immersed portion of the stopper rod will not be exposed to overpressure (i.e. positive pressure) and so mechanical stress on the immersed portion is reduced (this is particularly advantageous when a two-part stopper is employed having a separate nose part affixed at the lower end of the stopper rod or more usually a copressed nose/body assembly). Moreover, as the restrictor is exposed to less heat when in the upper half of the stopper rod, it can be made from a wider variety of materials. It will also be noted that the low-pressure region (i.e. the outlet of the restrictor) should be below the surface of the molten metal to avoid air ingress through the porous walls of the stopper rod.

It will be appreciated that all that is required of the restrictor is that it provides an increased resistance to flow so as to cause an increase in pressure upstream thereof.

The internal shape of the stopper rod may constitute the restrictor or the restrictor may be a separate component in the form of a plug inserted within the axial bore.

In a particular embodiment the restrictor is made from non-porous material such as a refractory or metal and has at least one bore therethrough. Where a single bore is provided it may be co-axial with the axial bore of the stopper rod. Where a plurality of bores is provided (each preferably having its own inlet and outlet) they may be distributed evenly around the axis of the axial bore. Each of the plurality of bores may be parallel to or inclined to the axial bore. The cross-sectional shape of each bore is not particularly limited and each may independently be, for example, circular, elliptical or rectangular. Furthermore, the cross-sectional shape of each bore may vary along its length and the cross-sectional area of each bore may increase, decrease or remain constant along its length.

Alternatively, the restrictor may be made from a porous material such as a refractory or metal. Examples of suitable porous structures include foams and partially sintered solids.

In the case where the at least one bore is constituted by a single bore of circular cross section it may have a diameter at its narrowest point of between 0.5 mm to 4 mm, preferably 0.75 mm to 3 mm. However, it will be understood that the size of the restriction (i.e. the cross-sectional area of the bore) will be chosen to provide the desired backpressure for a particular flow rate through the stopper rod.

In a particularly preferred arrangement the restrictor has a narrower inlet than outlet, for example formed by having a stepped bore.

It will be understood that the longer the restrictor, the greater the degree of variation permitted in the position of the stopper rod relative to the surface of molten metal in the tundish to ensure that the outlet of the restrictor is below the top of the slag layer (i.e. to ensure that positive pressure is provided at all points above the slag layer so that air ingress is prevented). However, an increase in the length of the restrictor will result in an increase in backpressure. Furthermore, decreasing the cross-sectional area of the bore(s) will also result in an increase in backpressure. Consequently, the length of the restrictor and the cross-sectional area of the bore(s) should be carefully chosen to achieve the desired backpressure.

Stopper rods are generally mounted by a fixing rod secured within the axial bore of the stopper. The gas supply conduit may be constituted by a passage through the fixing rod. Alternatively, the gas supply conduit may be an additional bore or bores extending from the outer surface of the stopper rod to the axial bore.

In a certain embodiment, the stopper rod body is provided with a rounded or frusto-conical nose at the second end. The body may be formed in one-piece or may comprise an elongate tubular part co-pressed with a nose part.

In use, argon may be provided through the axial bore.

According to a third aspect of the present invention there is provided a method for controlling the flow of molten metal from a tundish comprising: providing a tundish having at least one tundish outlet for discharging molten metal therethrough; vertically orientating a stopper rod according to the first aspect of the invention, with its second end disposed within the at least one tundish outlet to temporarily prevent molten metal from flowing therethrough; flowing molten metal into the tundish to an operating depth; and vertically moving the stopper rod out of and into the at least one tundish outlet to thereby control the flow of molten metal therethrough; wherein the restrictor is located vertically within the axial bore of the stopper rod such that the outlet of the restrictor is below the surface of molten metal in the tundish, when the stopper rod is moving out of and into the at least one tundish outlet.

BRIEF DESCRIPTION OF THE DRAWINGS

The invention will now be described, by way of an example only, with reference to the accompanying drawings, in which:

FIG. 3 shows a cross-sectional view along the longitudinal axis of a stopper rod according to an embodiment of the present invention;

FIG. 4 shows a graph illustrating the relative pressure variation along the length of the stopper rod of FIG. 3;

FIG. 5A shows a top plan view of a restrictor in accordance with an embodiment of the invention;

FIG. 5B shows a side cross-sectional view of the restrictor of FIG. 5A;

FIG. 5C shows an enlarged cross-sectional view similar to that of FIG. 5B;

DETAILED DESCRIPTION OF CERTAIN EMBODIMENTS

Figure 1:
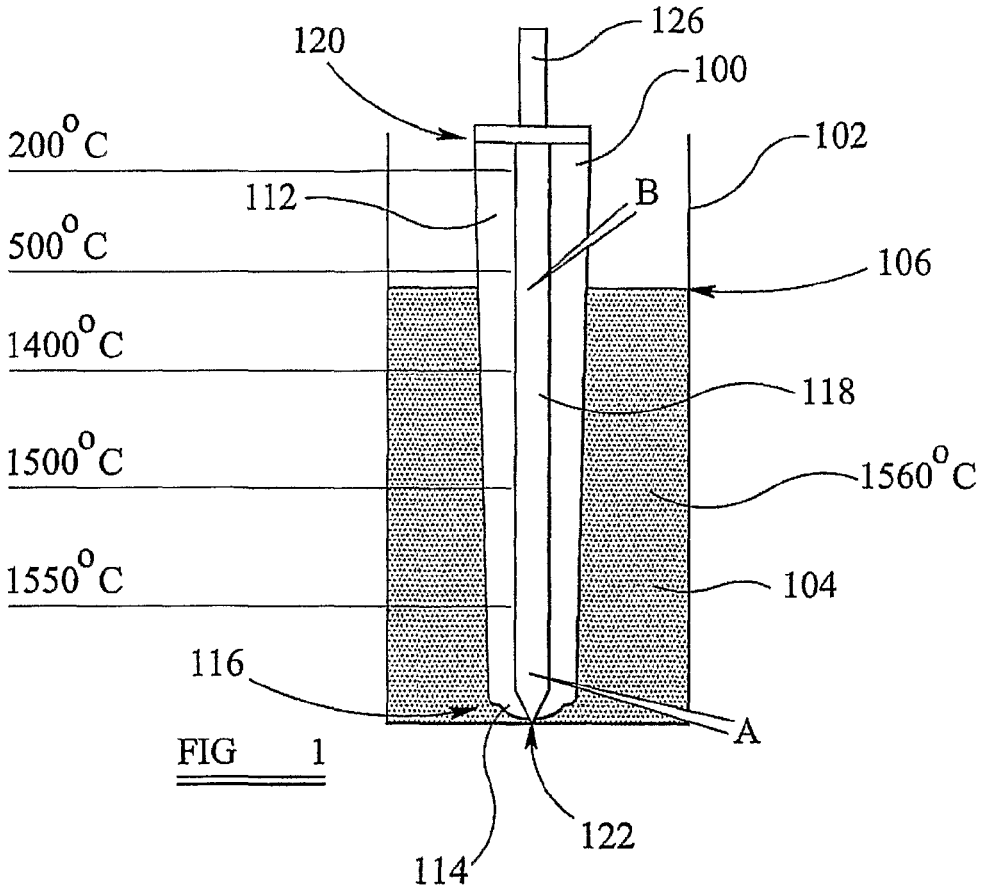
FIG. 1 illustrates the temperature variance of gas flowing along a stopper rod when positioned in a tundish containing molten metal to an operating depth.

FIG. 1 illustrates the gas temperature variance along a stopper rod 100 when positioned in a tundish 102 containing molten steel 104 to an operating depth 106 (i.e. to a certain height above the tundish 102 floor). The stopper rod 100 comprises an elongate tubular part 112 with a co-pressed rounded nose part 114 at its lower (second) end 116. A continuous axial bore 118 is provided from the upper (first) end 120 of the tubular part 112 to a tip 122 of the nose 114. The bore 118 has a substantially constant circular cross-section along the length of the tubular part 112 and tapers inwardly in the nose 114. The stopper rod 100 is held in a vertical position in the tundish 102 by a fixing rod 126. The stopper rod 100 is approximately the same length as the height of the tundish 102. As can be seen, the surface of the molten steel 104, at its operating depth 106, is approximately 70% of the way up the stopper rod 100 from its lower end 116 (and approximately 70% of the way up the tundish 102).

In use, the temperature of the molten steel 104 in the tundish 102 is approximately 1560° C. However, the temperature of the gas within the axial bore 118 of the stopper rod 100 (and hence the temperature of the inner surface of the bore 118 of the stopper) varies along its length. Thus, adjacent the upper end 120 of the stopper rod 100 the temperature of the gas is approximately 200° C. and at a position just above the operating level 106 of the molten steel 104 in the tundish 102 the temperature is approximately 500° C. Down approximately a fifth of the depth of the molten steel 104, the temperature of the gas is approximately 1400° C., at approximately halfway down the depth of the molten steel 104, the temperature is approximately 1500° C., and at approximately three-quarters of the way clown the depth of the molten steel 104, the temperature is approximately 1550° C.

Figure 2:
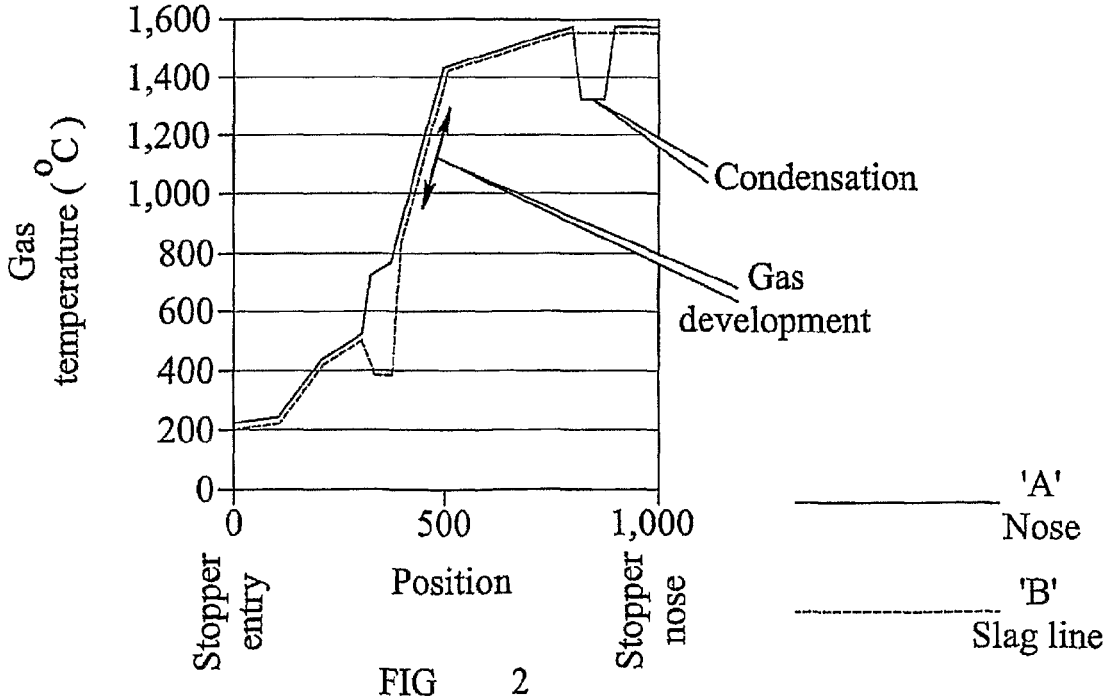
FIG. 2 shows a graph of gas temperature versus distance along a stopper rod—for the case where a restriction is positioned adjacent the stopper nose, as in the prior art, and the case where a restrictor is positioned close to the surface of the molten metal in the tundish, in accordance with an embodiment of the invention.

The calculated gas temperatures at various positions along the stopper rod 100 are shown graphically in FIG. 2 for the case where a restriction (not shown) is positioned adjacent the stopper nose 114 (marked position 'A' in FIG. 1) and the case where a restrictor 32 (shown in FIG. 3) is positioned at the operating (slag) level 106 of the molten steel 104 (marked position 'B' in FIG. 1). Thus, the Applicants have found that, with a restrictor in position A, the gas flowing through the axial bore 118 experiences a sudden temperature drop adjacent the stopper rod nose 114 which can cause condensation of the materials produced during a preceding out-gassing phase (when the temperature of the stopper rod 100 is between approximately 900 and 1400° C.). However, with the restrictor 32 positioned adjacent the operating level 106 of the molten steel 104, the gas experiences a temperature drop upstream of the generation of the out-gassing materials and so there is less chance of undesirable chemical species being deposited in the restrictor 32. Consequently, providing the restrictor 32 higher up towards the cooler upper end 120 of the stopper rod 100 reduces the likelihood of the restrictor 32 becoming blocked due to the physical deposition of chemical species.

Although not wishing to be bound by theory, the Applicants believe that the following chemical reactions may occur as a result of out-gassing in the stopper rod 100. At above 983° C. carbon monoxide is formed (equation 1). The carbon monoxide then reacts with silicon to form silica (equation 2). In addition, magnesium oxide may react with carbon to form magnesium and carbon monoxide (equation 3). Forsterite may then be formed from magnesium and silica (equations 4 and 5).

$$C_{(s)}+O_{2(g)}\rightarrow CO_{(g)}+\tfrac{1}{2}O_{2(g)} \qquad \text{Equation 1}$$

$$Si_{(s,l)}+CO_{(g)}\rightarrow SiO_{(g)}+C_{(s)} \qquad \text{Equation 2}$$

$$MgO_{(s)}+C_{(s)}\rightarrow Mg_{(g)}+CO_{(g)} \qquad \text{Equation 3}$$

$$Mg_{(g)}+4SiO_{(g)}\rightarrow Mg_2SiO_{4(s)}+3Si_{(s,l)} \qquad \text{Equation 4}$$

$$2Mg_{(g)}+SiO_{(g)}+3/2O_{2(g)}\rightarrow Mg_2SiO_{4(s)}+3Si_{(s,l)} \qquad \text{Equation 5}$$

Some or all of the above reactions may be the cause of chemical deposits which block traditional restrictions in use. However, for the reasons stated above it is believed that embodiments of the present invention overcome this problem.

With reference to FIG. 3, there is illustrated a stopper rod 10 according to an embodiment of the present invention. The stopper rod 10 has an elongate tubular part 12 with a rounded nose part 14 at its lower (second) end 16, formed by co-pressing the two parts. A continuous axial bore 18 is provided from the upper (first) end 20 of the tubular part 12 to a tip 22 of the nose 14. The axial bore 18 has a substantially constant circular cross-section of about 38 mm along the length of the tubular part 12. In the upper portion of the nose 14, the sidewall 23 of the bore 18 curves inwardly before forming a gently inwardly tapering frusto-conical spout 24 which exits at the tip 22. Typically, the bore 18 at the exit from the tip 22 has a diameter of approximately 3-5 mm.

The upper end 20 of the tubular part 12 is configured to receive a fixing rod 26 when in use. Thus, towards the upper end 20, a threaded ceramic insert 28 is provided in the sidewall of the bore 18 for engagement with the end of the fixing rod 26. Upstream of the ceramic insert 28 a gasket 30 is provided between the fixing rod 26 and the tubular part 12 to produce an airtight seal therebetween. The fixing rod 26 has a bore through which argon gas can be fed into the axial bore 18 of the stopper rod and therefore in this embodiment serves as the gas supply conduit. In addition, a free end of the fixing rod 26 is attached to a support mechanism (not shown) configured for controlling the height and position of the stopper rod 10, in use.

In the upper half of the stopper rod 10, a restrictor 32 in the form of a "plug" is provided within the bore 18. In the embodiment illustrated, the restrictor 32 is positioned downstream of the upper end 20 of the stopper rod 10 by about 30% of the length of the stopper rod 10. The restrictor 32 comprises a cylindrical body 36 with a central circular bore 38 of constant cross-section therethrough. The restrictor 32 is made from alumina and has a bore 38 diameter of approximately 1 mm and a length (i.e. distance between an inlet 34 and outlet 35) of approximately 35 mm (which corresponds to approximately 3.5% of the length of the stopper rod 10).

It will be understood that, in use, the restrictor 32 causes an increased resistance to flow through the axial bore 18 and this results in an increase in pressure upstream of the restrictor inlet 34 (i.e. backpressure). A predetermined amount of backpressure can be provided by carefully choosing the size of the bore 38 (i.e. length and cross-sectional area) and the flow rate of gas (e.g. argon) through the axial bore 18. In a particular embodiment, it is desirable to make the pressure upstream of the restrictor 32 positive (i.e. equal to or greater than atmospheric pressure) and the pressure downstream of the restrictor 32 negative since this arrangement inhibits air ingress above the restrictor 32 and reduces the mechanical stress due to high pressure below the restrictor 32. A graph illustrating such a pressure drop between the points where the gas enters the upper end 20 of the stopper rod 10 and exits the lower end 16 of the stopper rod 10, is shown in FIG. 4. Thus, it can be seen that a large pressure drop (from positive to negative) is experienced between the inlet 34 and outlet 35 of the bore 38 of the restrictor 32. Immediately below the outlet 35 of the restrictor 32 the gas pressure increases slightly but remains negative. The pressure of the gas then remains substantially constant to the stopper nose 14. As the bore 18 in the nose 14 tapers inwardly towards the tip 22, the pressure of the gas drops slightly before it exits the stopper rod 10. It will be understood that the level of negative pressure in the lower end 16 of the stopper rod 10 depends upon the flow rate of molten metal past the stopper nose 14 and the geometry of the stopper rod 10 and the submerged entry nozzle with which it is being used.

FIGS. 5A, B and C show an alternative restrictor 40 which, in an embodiment of the invention, may be employed in a stopper rod such as that illustrated in FIG. 3. The restrictor 40 comprises a frusto-conical body 42 that tapers slightly outwardly towards an upper end 44 of the body 42. At the upper end 44 a further frusto-conical section 46 is provided which tapers inwardly at approximately 45° to the horizontal. The frusto-conical section 46 has an upper terminating plane 48 of approximately half the width of the upper end 44. A shallow rounded tip 50 extends upwardly from the plane 48. A narrow (1 mm diameter) bore 52 is provided vertically through the centre of the tip 50. In the plane 48 the bore 52 is stepped to form a larger (3 mm diameter) bore 54 that extends through the centre of the frusto-conical section 46 and the body 42. Accordingly, in this embodiment, an inlet 56 is provided at the upper end of the narrow bore 52 and an outlet 57 is provided at the lower end of the larger bore 54.

Figure 6:
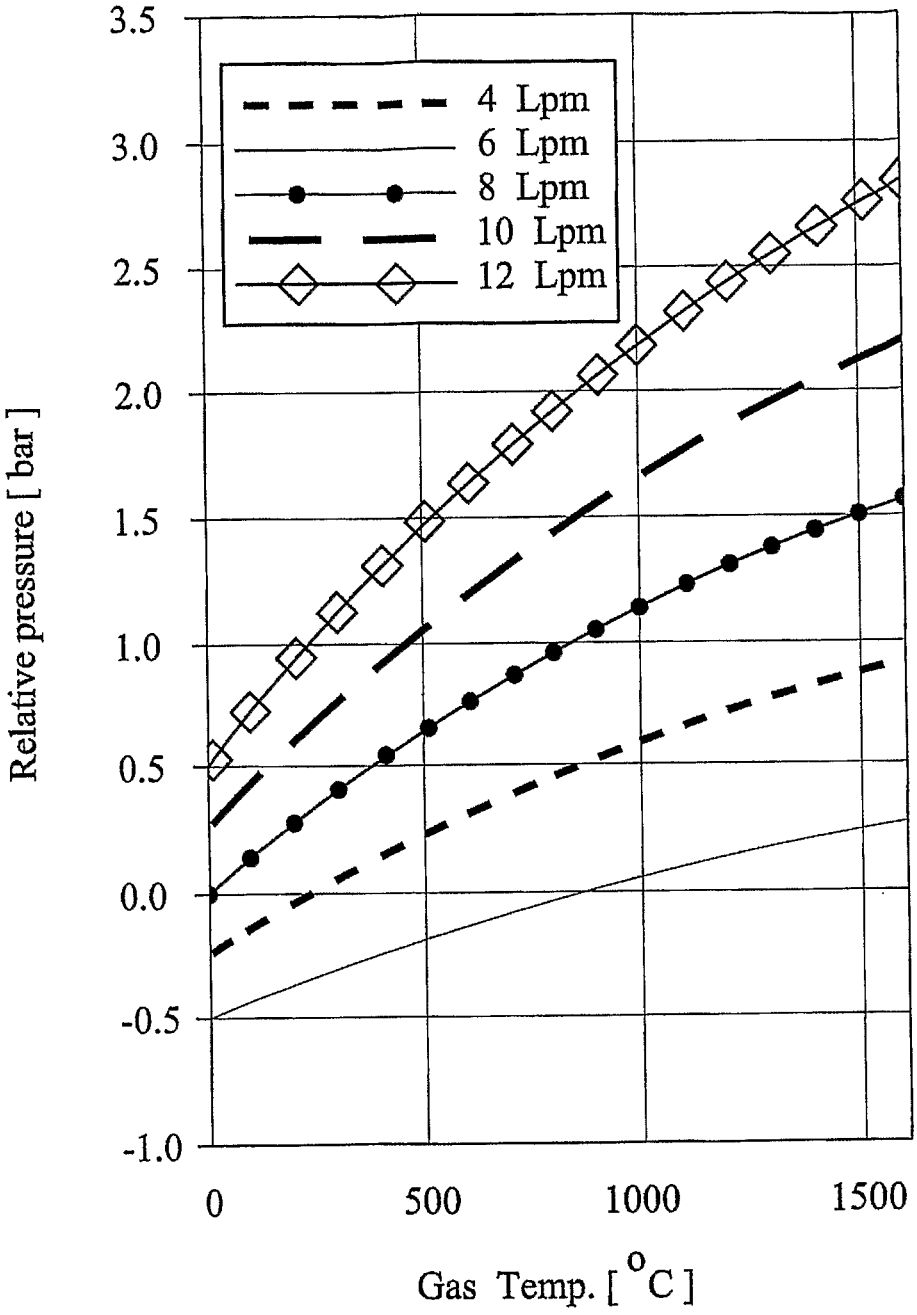
FIG. 6 shows a calculated plot of pressure versus gas temperature when argon is flowed through the stopper rod of FIG. 3 at respective entry rates of 4, 6, 8, 10 and 12 norm liters/minute (i.e. at 1 bar pressure and 20° C.) and is representative of the backpressure achieved with a restrictor positioned according to the plotted temperature.

FIG. 6 shows a graph of calculated pressure upstream of the restrictor 32 plotted against gas temperature when argon is flowed through the stopper rod 10 of FIG. 3 (i.e. with a bore 38 diameter of 1 mm) at respective rates of 4, 6, 8, 10 and 12 norm liters/minute. The temperature scale is representative of the position of the restrictor within the axial bore of the stopper rod (i.e. higher temperatures are representative of the restrictor being positioned further down the bore). Accordingly, it can be seen from FIG. 6 that a flow rate of 8 l/min through the restrictor in the traditional nose position (1500° C.) creates a relative backpressure of 1.5 bar, whereas when positioned at the slag line (500° C.) a flow rate of 12 l/min can be employed at the same relative backpressure. This is advantageous because the increased throughput of argon means that the stopper rod can be used in conjunction with larger moulds.

Figure 7:
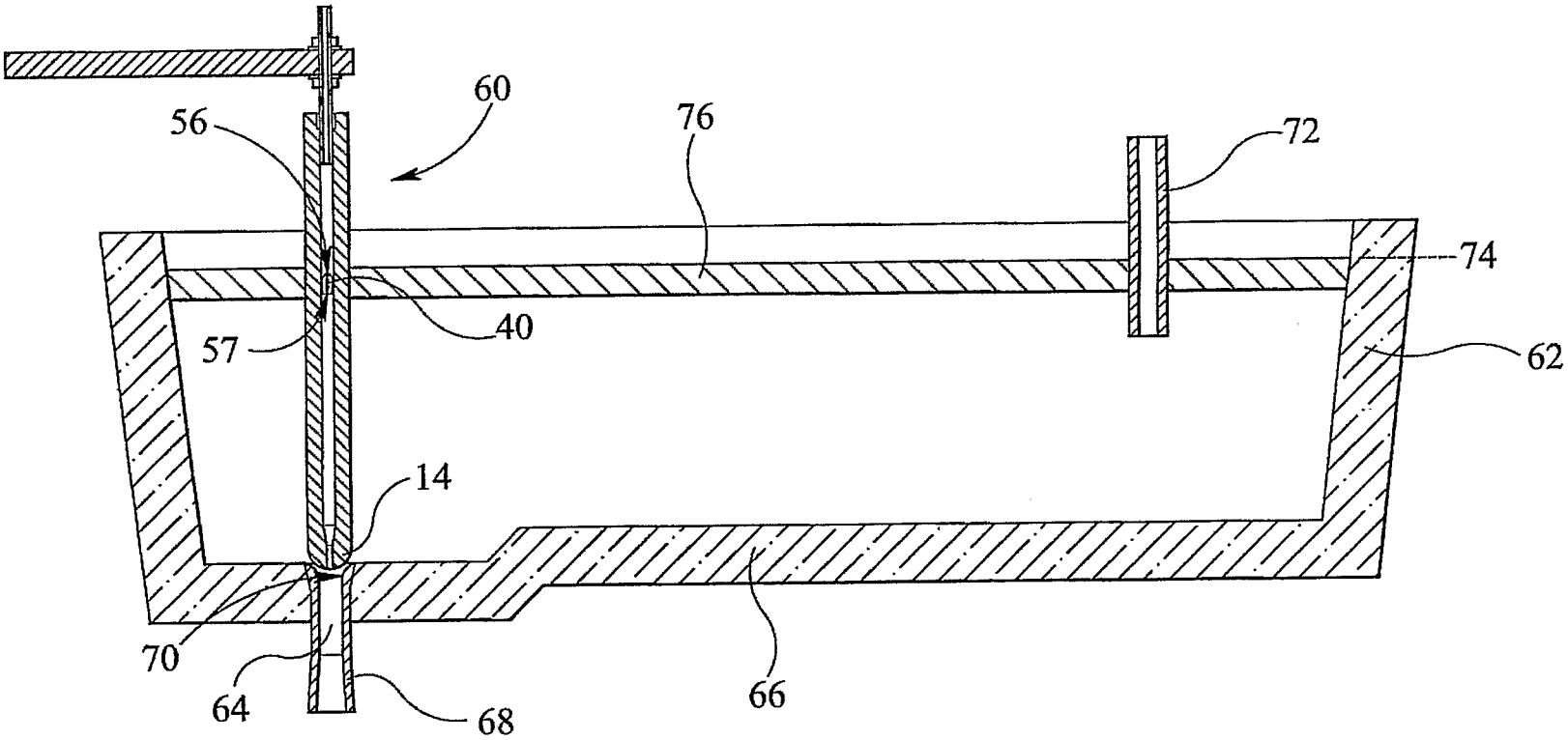
FIG. 7 illustrates a stopper rod according to an embodiment of the invention, in use in a tundish.

FIG. 7 shows a cross-sectional view of a stopper rod 60 according to a further embodiment of the invention, in use in a tundish 62. The stopper rod 60 is substantially similar to that shown in FIG. 3 and so like reference numerals will be used for like parts. As can be seen from FIG. 7, the stopper rod 60 is positioned vertically above an outlet 64 in the base 66 of the tundish 62. Surrounding the outlet 64 is a submerged entry nozzle 68 that guides the molten metal to a mould below (not shown). The inlet of the submerged entry nozzle 68 comprises a convexly curved throat region 70. In use, the rounded nose 14 of the stopper rod 60 is raised and lowered within the throat region 68 to control the flow of molten metal through the submerged entry nozzle 68. At a position removed from the stopper rod 60, a ladle shroud 72 is provided. Although not shown, the ladle shroud 72 is configured to guide metal from a ladle disposed there above.

As can be seen from FIG. 7, when molten metal is provided to an operating depth 74 in the tundish, the lower end of the ladle shroud is below the slag layer 76. Furthermore, in this embodiment, the restrictor 40 is provided in the stopper rod 60 with its inlet 56 below the top surface of the slag layer 76 and its outlet 57 provided above the bottom surface of the slag layer 76. Thus, in use, a positive pressure will be provided above the restrictor 40 (i.e. above the slag layer 76) and a negative pressure will be provided below the restrictor 40 (i.e. below the slag layer 76). Accordingly, air ingress above the restrictor 40 will be avoided and the risk of blockages due to the physical deposition of chemical species in the restrictor 40 is greatly reduced due to its higher, cooler position within the stopper rod 60.

It will be appreciated by persons skilled in the art that various modifications may be made to the above-described embodiments without departing from the scope of the present invention. For example, whilst the above discussion has been concerned with stopper rods used in tundishes, aspects of the invention are equally applicable to stopper rods used in other applications.

The invention claimed is:

1. A stopper rod comprising:

an elongate body having an inlet at an upper first end and an outlet at a lower second end, the second end of the body defining a nose for insertion into a tundish outlet;

a continuous axial bore extending through the body from the inlet to the outlet;

a restrictor having an inlet, an outlet and a passageway therebetween, said restrictor being constituted by a plug positioned in the axial bore such that the inlet of the restrictor is closer to the first end than the second end and such that the outlet of the restrictor is spaced from the second end and the nose; and a gas supply conduit arranged to supply gas into the axial bore above the inlet of the restrictor.

2. The stopper rod according to claim 1 wherein the axial length of the restrictor is less than 10% of the length of the stopper rod.

3. The stopper rod according to claim 1 wherein the outlet of the restrictor is spaced from the second end of the stopper rod.

4. The stopper rod according to claim 1 wherein the restrictor comprises porous material.

5. The stopper rod according to claim 1 wherein the restrictor comprises non-porous material and the passageway is constituted by at least one bore therethrough.

6. The stopper rod according to claim 1 wherein the passageway is constituted by a bore which is co-axial with the axial bore of the stopper rod.

7. The stopper rod according to claim 1 wherein a plurality of passageways are provided.

8. The stopper rod according to claim 1 wherein the restrictor has a narrower inlet than outlet.

9. An apparatus for controlling the flow of molten metal from a tundish comprising:

a tundish configured for receiving molten metal to an operating depth and having at least one tundish outlet for discharging molten metal therethrough;

a stopper rod according to claim 1, orientated vertically with its second end disposed above the at least one tundish outlet and movable vertically into and out of the at least one tundish outlet whereby to control the flow of molten metal through the at least one tundish outlet;

the restrictor in the stopper rod being located vertically within the axial bore such that, in use, the outlet of the restrictor is below the surface of molten metal in the tundish.

10. The apparatus according to claim 9 wherein the outlet of the restrictor is located at a distance of less than 70% of the length of the stopper rod when measured from the second end.

11. A method for controlling the flow of molten metal from a tundish comprising:

providing a tundish having at least one tundish outlet for discharging molten metal therethrough;

vertically orientating a stopper rod according to claim 1, with its second end disposed within the at least one tundish outlet to temporarily prevent molten metal from flowing therethrough;

flowing molten metal into the tundish to an operating depth; and vertically moving the stopper rod out of and into the at least one tundish outlet to thereby control the flow of molten metal therethrough;

wherein the restrictor is located vertically within the axial bore of the stopper rod such that the outlet of the restrictor is below the surface of molten metal in the tundish, when the stopper rod is moving out of and into the at least one tundish outlet.

* * * * *